US005779874A

United States Patent [19]

Lemke

[11] Patent Number: 5,779,874

[45] Date of Patent: Jul. 14, 1998

[54] CHLOR ALKALI CELLS METHOD AND CELL COMPRESSION SYSTEM

[76] Inventor: Chris A. Lemke, 369 W. Gettysburg Ave., Clovis, Calif. 93612

[21] Appl. No.: 603,987

[22] Filed: Feb. 20, 1996

[51] Int. Cl.[6] ..... C25B 9/00

[52] U.S. Cl. ..... 205/334; 204/252

[58] Field of Search ..... 204/252, 263–266; 205/334

[56] References Cited

U.S. PATENT DOCUMENTS

| | | | |
|---|---|---|---|
| 3,702,267 | 11/1972 | Grot | 136/146 |
| 4,013,535 | 3/1977 | White | 204/252 |
| 4,029,565 | 6/1977 | Bender et al. | 204/252 X |
| 4,201,652 | 5/1980 | Dupre, III | 204/258 |
| 4,219,394 | 8/1980 | Babinsky et al. | 204/98 |
| 4,391,693 | 7/1983 | Pimlott | 204/237 |
| 4,441,977 | 4/1984 | Ford | 204/252 |
| 4,493,759 | 1/1985 | Boulton et al. | 204/252 |
| 4,555,323 | 11/1985 | Collier | 204/258 |

*Primary Examiner*—Donald R. Valentine

[57] ABSTRACT

A chlor-alkali cell (10) contains components that require physical isolation between the anode compartment (20), cathode compartment (30), and outside environment. The cell (10) also contains a membrane (50) that provides selective electrical conductivity between the anode compartment (20) and cathode compartment (30). The cell compression system consists of a single cell compression sleeve (40) at houses the components of the chlor-alkali cell (10). The cell compression sleeve (40) uniformly distributes and maintains a compressive force along an anode seal (60) and cathode seal (61) membrane (50) which is located at the junction of the anode compartment (20) and cathode compartment (30).

8 Claims, 6 Drawing Sheets

CHLOR ALKALI CELLS METHOD AND CELL COMPRESSION SYSTEM

BACKGROUND

1. Field of the Invention

This invention relates, generally, to improvements in electrolytic cells that generate chlorine gas and caustic solutions and delivers those products to a drinking water supply system, wastewater treatment system, industrial processing system, or a swimming pool. More particularly, it relates to an improved means for containing the electrolytes and membrane of the cell.

2. Description of Prior Art

U.S. Pat. Nos. 4,555,323 (1985); 4,493,759 (1985); 4,391,693 (1983); 4,219,394 (1980); 4,201,652 (1980); 3,702,267 (1972) and the references to record therein are believed to represent the most relevant prior art to this disclosure.

Chlor-alkali cells provide an electromotive force to split the chemical bond between sodium and chlorine elements of ordinary sodium chloride (table salt). Chlorine is used as a disinfectant in water, wastewater, and swimming pool applications. Chlorine is also used as an oxidant in water, wastewater, and industrial treatment processes. The sodium produced from the process combines with water to form sodium hydroxide (caustic) which is used as a disinfectant and pH control chemical in water, wastewater and swimming pool applications. Caustic is also used as a cleansing chemical agent in several processes.

The chlor-alkali process in its simplest form, employs the use of an anode electrode, cathode electrode, a membrane placed between the two electrodes, and solutions called electrolytes. The process employs an electrical current within the electrolytes to generate the products of the process, mainly chlorine gas and sodium hydroxide (caustic soda). The components of the chlor-alkali process are contained within a cell. The cell in conjunction with the membrane provide isolation of the electrolytes generated at each electrode. The cell also provides isolation of the of the chlor-alkali process with the outside environment. The necessity of the cell and membrane to isolate the electrolytes is discussed extensively in the prior art. The necessity of the cell to isolate the chlor-alkali process from the environment is obvious since the products of the process are hazardous to the humans and the surrounding environment.

The electrolyte at the anode is generally referred as the anolyte, and is primarily a saturated saltwater brine solution. The electrolyte at the cathode is generally referred as the catholyte, and is primarily a solution of sodium hydroxide, or caustic soda. The need to isolate the electrolytes with a membrane are primarily for process control and efficiency.

The claims in the prior art describe several complicated apparatuses or methods to connect the cell compartments and membrane to achieve isolation of the electrolytes. Babinsky (No. 4,219,394) describes a membrane heat sealed to an impermeable frame that is positioned within a cell to provide the necessary sealing means between the electrolytes. Boulton (No. 4,493,759) describes a gasket system with a plurality of projections and recesses between the two compartments. Collier (No. 4,555,323) describes a threaded connection or welded connection to connect to two compartments. Dupre (No. 4,201,652) describes a synthetic separator and bolt system between the two compartments. Pimlott (No. 4,391,693) and Grot (No. 3,702,267) describe a nut and bolt connection between the two compartments. All of these inventions demonstrate the complicated nature of designing a cell that prevents the mixing of electrolytes between the two compartments.

The apparatuses and methods described in the prior art claims would provide an adequate means of isolating the electrolytes of the cell compartments. However, maintenance of chlor-alkali cells requires routine access of the membrane to perform cleaning, treatment, or replacing. As demonstrated in the prior art, access or replacement of the membrane can be a complicated and time consuming process. This is especially true with the difficult removal of threaded metal connectors that eventually become oxidized (rusted) as a result of a small incidental chlorine gas leak from the cell.

In summary, the apparatuses described in the prior art employ several complicated methods to isolate the anode and cathode compartments of the chlor-alkali cell. The following are disadvantages known to exist with the prior art.

(a) A bolt or clamp means of isolating the cell compartments employs a time consuming process often involving several threaded connections. This is especially true for non-metal connector systems that use large quantities of plastic or fiberglass connectors to be equivalent to a single metal connector. The time spent for an operator to manipulate the bolt or clamp means to clean a membrane may often exceed the cost of the membrane.

(b) The apparatuses that require the use of metal threaded connectors may eventually oxidize or rust due to incidental chlorine gas leakage from the cell. Threaded connectors that are rusted are often difficult to remove and may result in making the cell inoperable due to the inability to replace the membrane.

(c) Several of the apparatuses in the prior art require complicated methods to remove and install the membrane isolation or sealing systems. These methods often require specialized training or extensive experience to ensure that the membrane is properly installed and that no leaks occur between the two compartments following the installation.

(d) The apparatuses that use a plastic divider or frame inserted within the cell experience a creep, or long term distortion of the impervious non-conductive material due to heat. With time, the divider eventually begins to allow a small leakage of the electrolytes around the sealed system which can eventually become large leaks.

(e) The apparatuses in the prior art do not describe a method to determine if migration of electrolytes occur around the membrane or sealing system. Several of the inventions have the sealed systems within the cell where observation of a leak would be virtually impossible, especially during operation where excessive heat can occur.

(f) The step of adding a heat sealed frame to the membrane increases the cost of the membrane.

(g) The use of recesses and projections requires an extensive capital cost for tooling molds.

(h) The welded connections do not allow easy replacement of the membrane between the two compartments.

OBJECTS AND ADVANTAGES

Accordingly, several objects and advantages of my invention are:

(a) to provide a cell having a single compression system that seals and confines the components of the cell and membrane isolation system;

(b) to design a cell and membrane isolation system that is quick and easy to install and maintain;

(c) to provide a cell having an isolation system that involves no frame, divider, welded, or multiple threaded or clamping connections;

(d) to provide a cell having no specialized frame or divider system that requires added tooling or specialized training to install and operate;

(e) to provide a cell with no metal or oxidizable connectors that can cause difficulty in maintaining the cell;

(f) to eliminate the potential of mixing the anolyte and catholyte electrolytes by utilizing two independent cell compartments, where potential cell leakage would occur outside of the cell rather than within the cell; and (g) to provide a cell where leakage of electrolytes around the sealing system can be observed, even during the operation of the chlor-alkali process, thus indicating the need to maintain or replace the seals between the cell compartments.

Further objects and advantages will become apparent from a consideration of the ensuing description and drawings.

DESCRIPTION OF DRAWINGS

For a fuller understanding of the nature and objects of the invention, reference should be made to the following detailed description, taken in consideration with the accompanying drawings in which:

FIG. 1A illustrates an electrolytic cell completely assembled and ready for operation.

FIG. 1B illustrates the order at which the cell is assembled within the cell compression sleeve.

FIG. 1C illustrates the relative shape of the electrolytic cell and cell compression sleeve.

FIG. 2A illustrates an electrolytic cell completely assembled and ready for operation.

FIG. 2B illustrates the order at which the cell and cell compression sleeve are assembled.

LIST OF REFERENCE NUMERALS

Figure 1A:
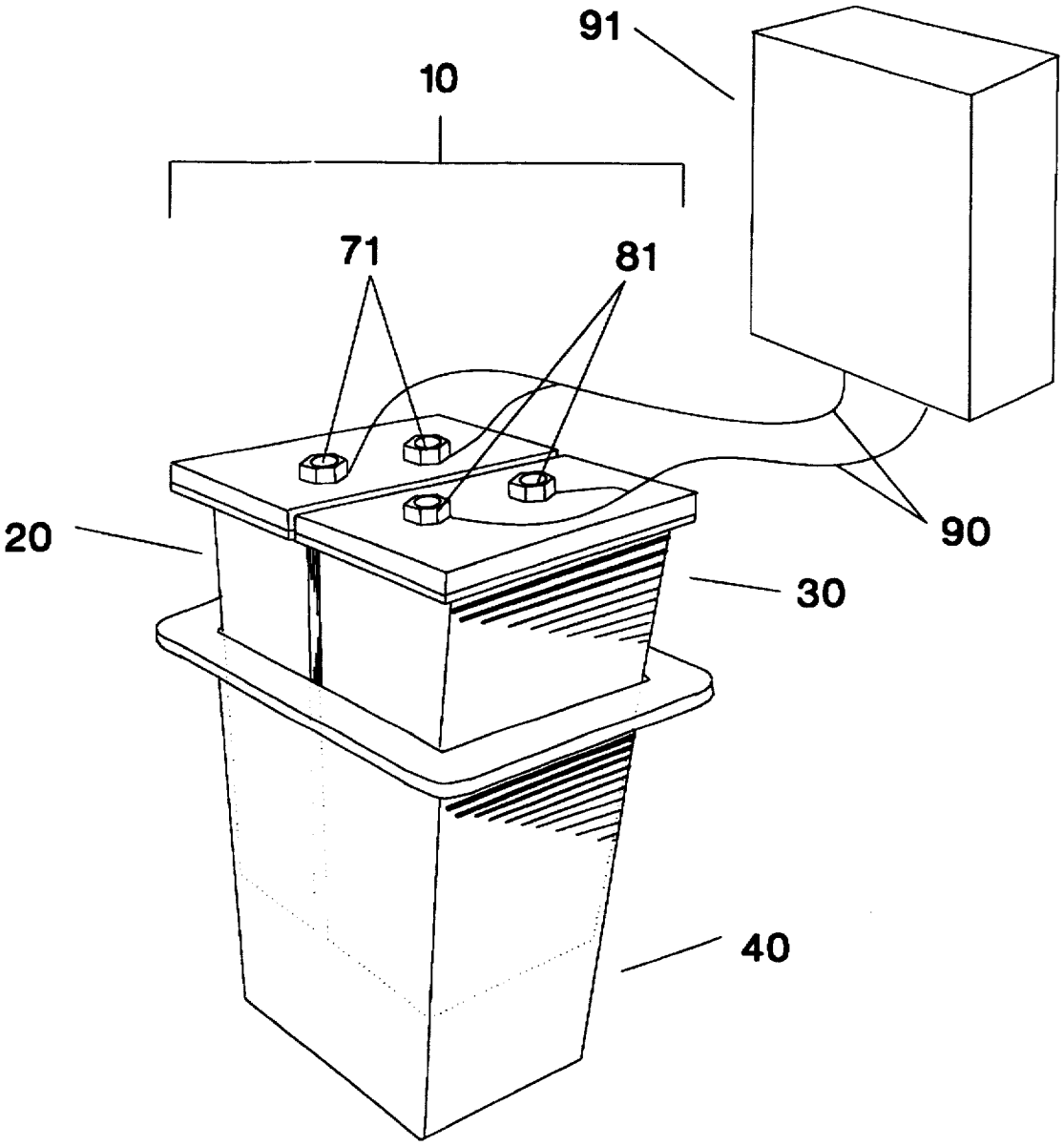
FIGS. 1A is an isometric representation of the invention showing a power source with electrical conduits connected to electrodes of an electrolytic cell contained within a cell compression sleeve.

| | | | |
|---|---|---|---|
| 10 | cell | | |
| 11 | tapered dimension | | |
| 20 | anode compartment | 30 | cathode compartment |
| 20B | anode compartment | 30B | cathode compartment |
| 21 | anode flange | 31 | cathode flange |
| 21B | anode flange | 31B | cathode flange |

-continued

| | | | |
|---|---|---|---|
| 22 | anode opening | 32 | cathode opening |
| 22B | anode opening | 32B | cathode opening |
| 23 | anode compartment opening | 33 | cathode compartment opening |
| 24 | anode lid | | |
| 25 | anode compartment flange | 34 | cathode lid |
| 26 | anode stem opening | 35 | cathode compartment flange |
| 26B | anode stem opening | | |
| 40 | cell compression sleeve | 36 | cathode stem opening |
| 40B | cell compression sleeve | 36B | cathode stem opening |
| 41B | exterior compression wedge | | |
| 42B | interior compression wedge | | |
| 43B | compression collar | | |
| 44B | compression collar opening | | |
| 45B | compression collar flange | | |
| 50 | membrane | | |
| 60 | anode seal | 61 | cathode seal |
| 60B | anode seal | 61B | cathode seal |
| 62 | anode lid seal | 64 | cathode lid seal |
| 63 | anode stem seal | 65 | cathode stem seal |
| 63B | anode stem seal | 65B | cathode stem seal |
| 70 | anode | 80 | cathode |
| 70B | anode | 80B | cathode |
| 71 | anode stem | 81 | cathode stem |
| 71B | anode stem | 81B | cathode stem |
| 72 | anode stem compression system | 82 | cathode stem compression system |
| 72B | anode stem compression system | 82B | cathode stem compression system |
| 90 | electrical conduit | | |
| 90B | electrical conduit | | |
| 91 | power supply | | |
| 91B | power supply | | |

SUMMARY

The present invention employs a cell compression system consisting of a cell, having two independent compartments which are isolated by the membrane, and a single cell compression sleeve that maintains compression between the two compartments thus forming a seal between the anode compartment, cathode compartment, and outside environment. The present invention eliminates the various complicated means described in the earlier patents of maintaining a seal between the anode and cathode compartments of the cell. The present invention also eliminates all potential mixing of electrolytes resulting from leaking around the sealing system, and establishes a method to observe leakage from the individual cell compartments when a seal fails.

It is therefore understood that the primary objective of this invention is to provide a cell and membrane isolation system that is quick and simple to install and maintain.

DESCRIPTION OF INVENTION

The configuration of the invention can partake several forms. It is the intention of this narrative to describe in detail the invention for a chlor-alkali system that produces 2.2–9.0 kilograms (5–20 pounds) of chlorine gas per day per cell. Illustrations of this type of system are shown in FIGS. 1A, 1B, 1C, and 1D. It is also the intention of this narrative to describe in detail the invention for a small chlor-alkali system that produces from 0.45–0.90 kilograms (1–2 pounds) of chlorine gas per cell per day. Illustrations of this type of system are shown in FIGS. 2A and 2B.

Figure 2A:
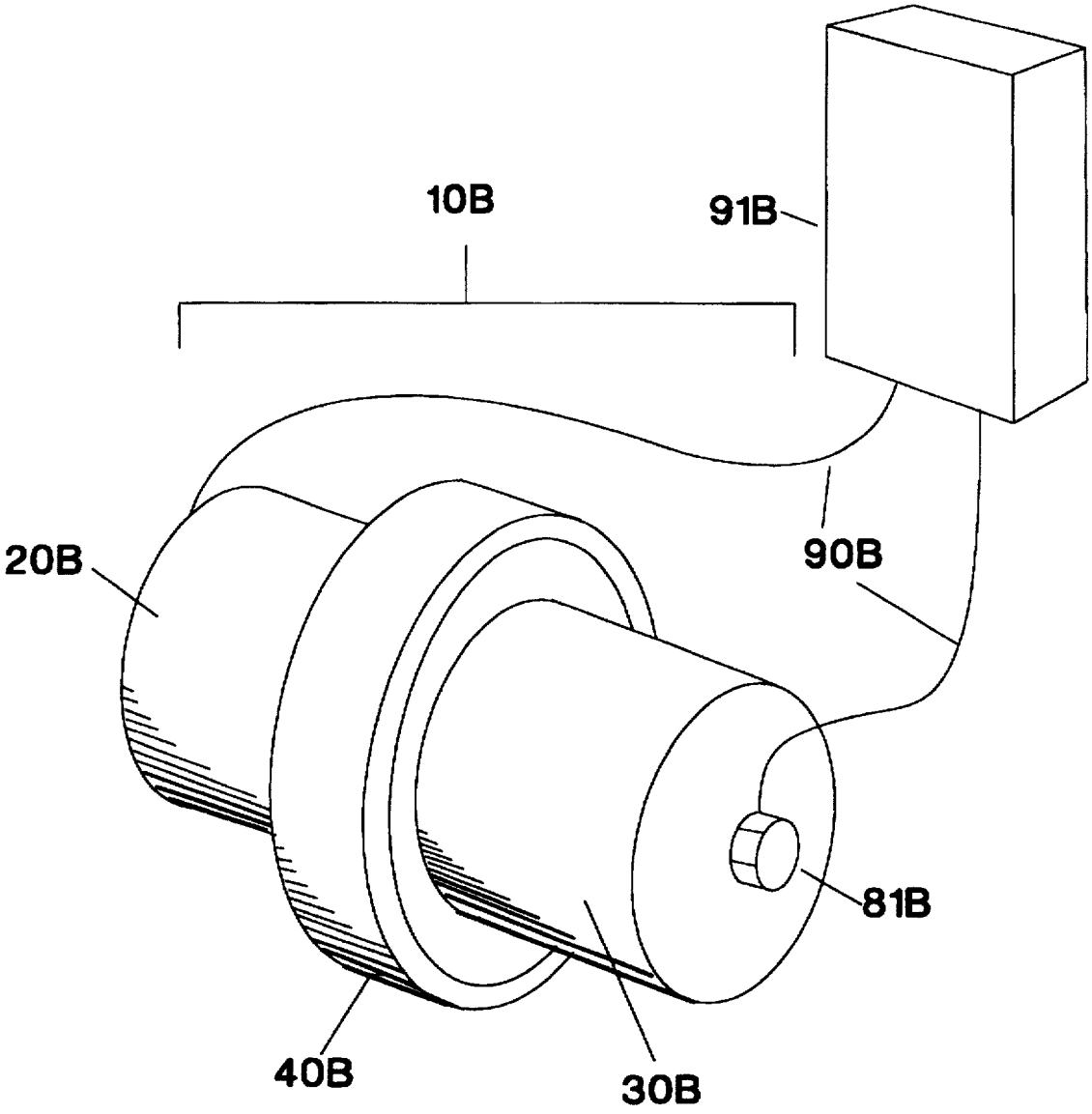
FIG. 2A is an isometric representation of the invention having a different configuration. The figure illustrates a power source with electrical conduits connected to electrodes of an electrolytic cell retained by a cell compression sleeve.
Figure 2B:
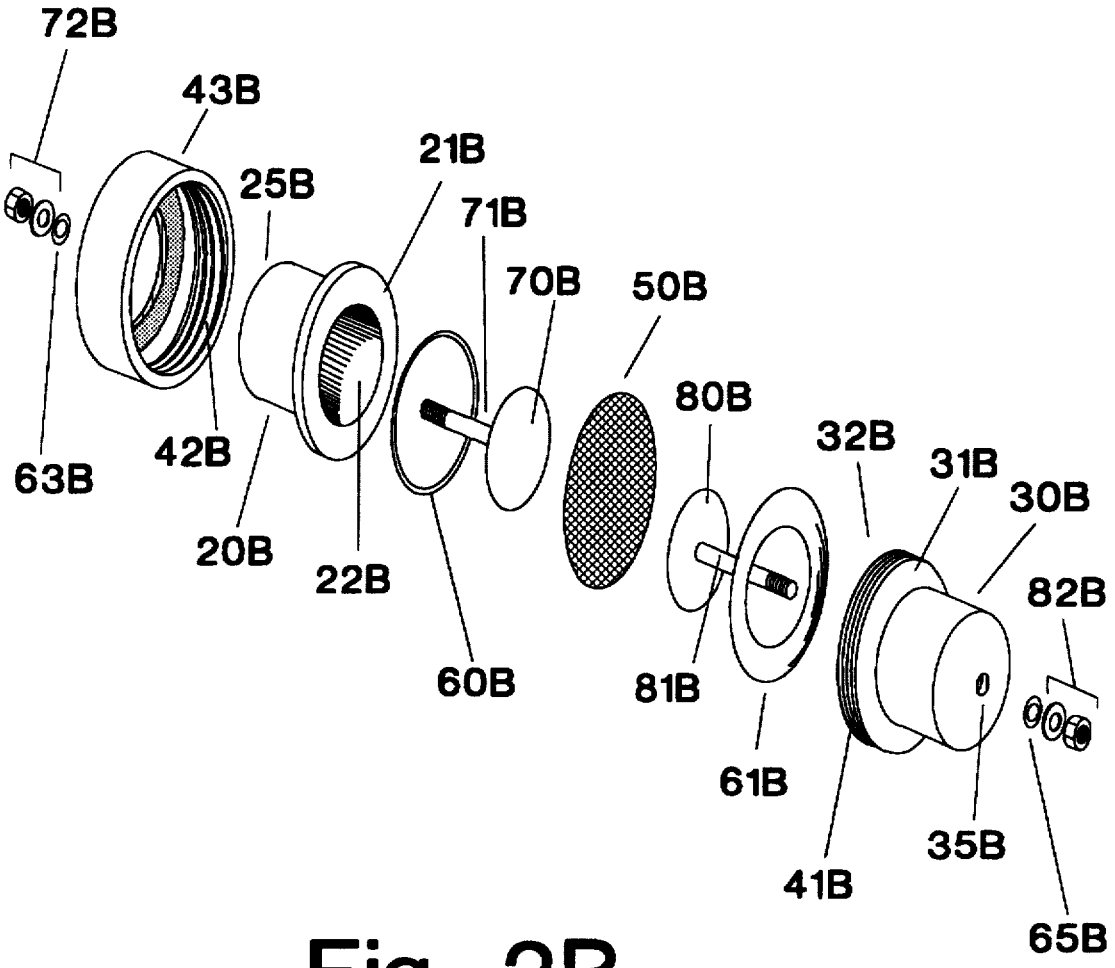
FIG. 2B is an isometric representation of the invention showing all the components of the electrolytic cell and cell compression sleeve.

FIG. 1A is an isometric representation of the invention in its assembled form. This invention would be used in chlorine use applications where 2.2–9.0 kilograms (5–20 pounds) of chlorine gas per cell per day are required. As shown in FIG. 1A, the invention is comprised of a cell having an anode compartment 20 and a cathode compartment 30, all contained within a cell compression sleeve 40.

Cell 10 is made of a rigid, non-electrically conductive material such as fiberglass, concrete, polyvinyl chloride PVC) plastic, chlorinated polyvinyl chloride (CPVC) plastic, polyvinylidene fluoride (PVDF) plastic, polytetrafluoroethylene (PTFE) plastic or other plastics that are chemically resistant to the solutions and gases contained within cell 10. More specifically, the material of anode compartment 20 must be chemically resistant to chlorine gas and anolyte contained in anode compartment 20. The material of cathode compartment 30 must also be chemically resistant to hydrogen gas and a catholyte contained in cathode compartment 30.

Cell compression sleeve 40 is made of a rigid material such as fiberglass, polyvinyl chloride (PVC) plastic, chlorinated polyvinyl chloride (CPVC) plastic, polyvinylidene fluoride (PVDF) plastic, polytetrafluoroethylene (PTFE) plastic, high density polyethylene (HDPE) plastic, concrete, or various types of metal including stainless steel, aluminum, and titanium. The interior of cell compression sleeve 40 may include a rubber or other type of lining to enhance the frictional properties of surfaces between cell compression sleeve 40 and cell 10. The interior material of cell compression 40 should be chemically resistant to the anolyte and catholyte solutions.

Figure 1B:
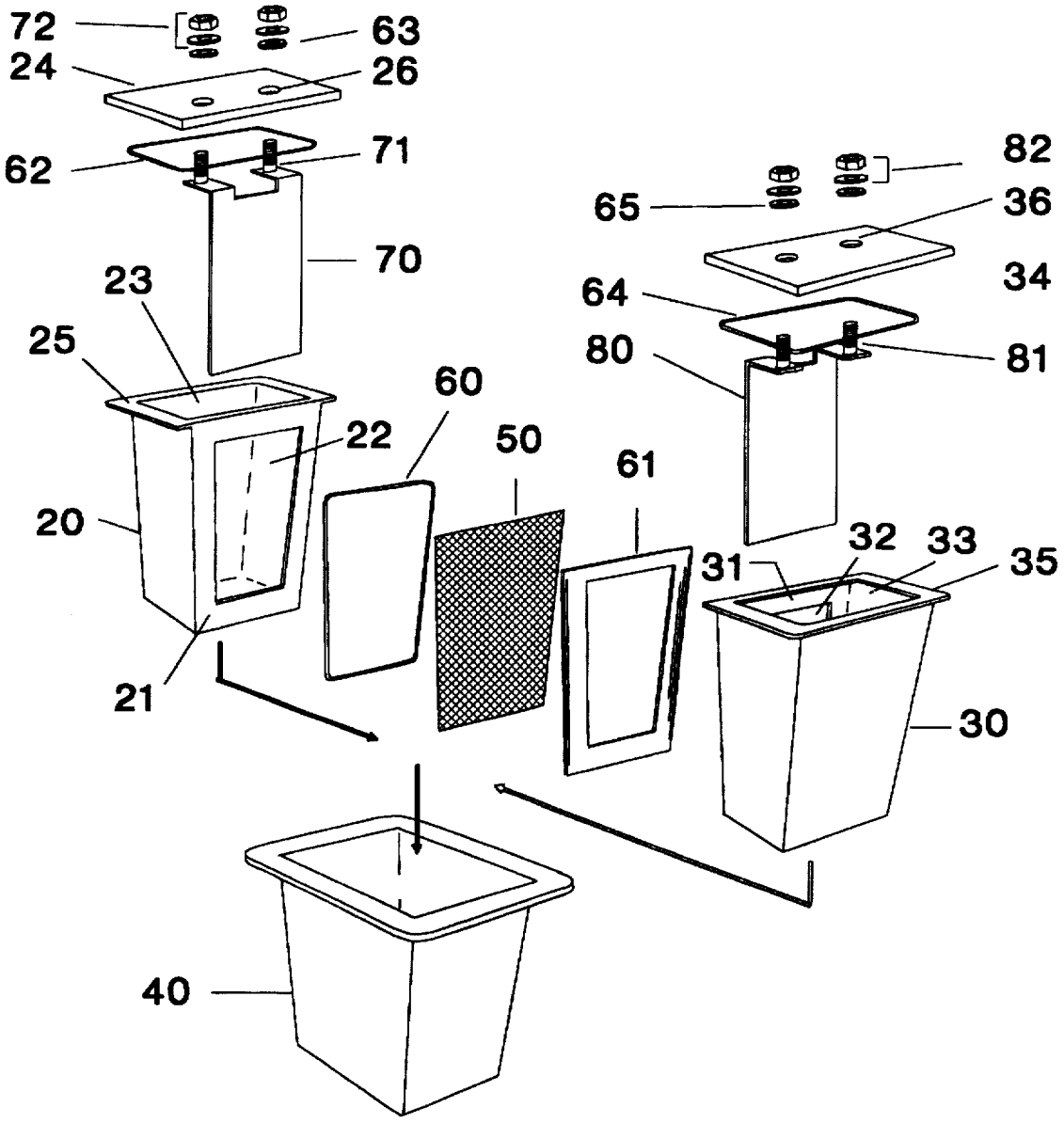
FIG. 1B is an isometric representation of the invention showing all the components of the electrolytic cell and cell compression sleeve.
Figure 1C:
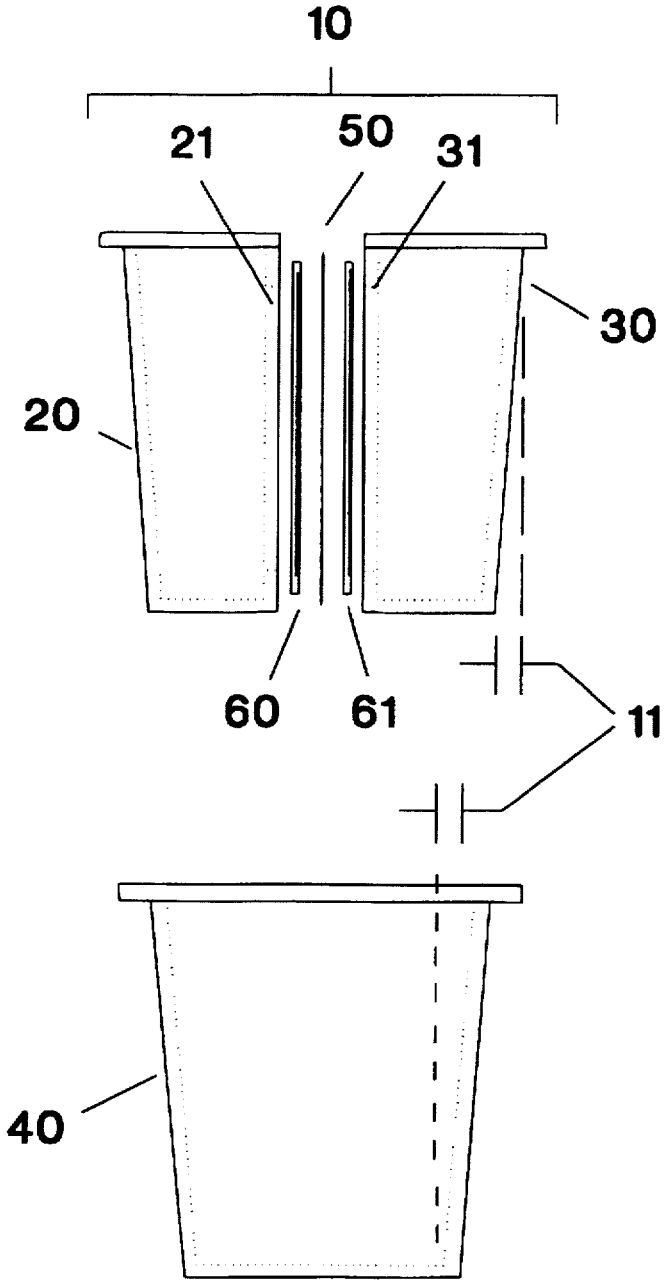
FIGS. 1C is a side view of the electrolytic cell and cell compression sleeve.
Figure 1D:
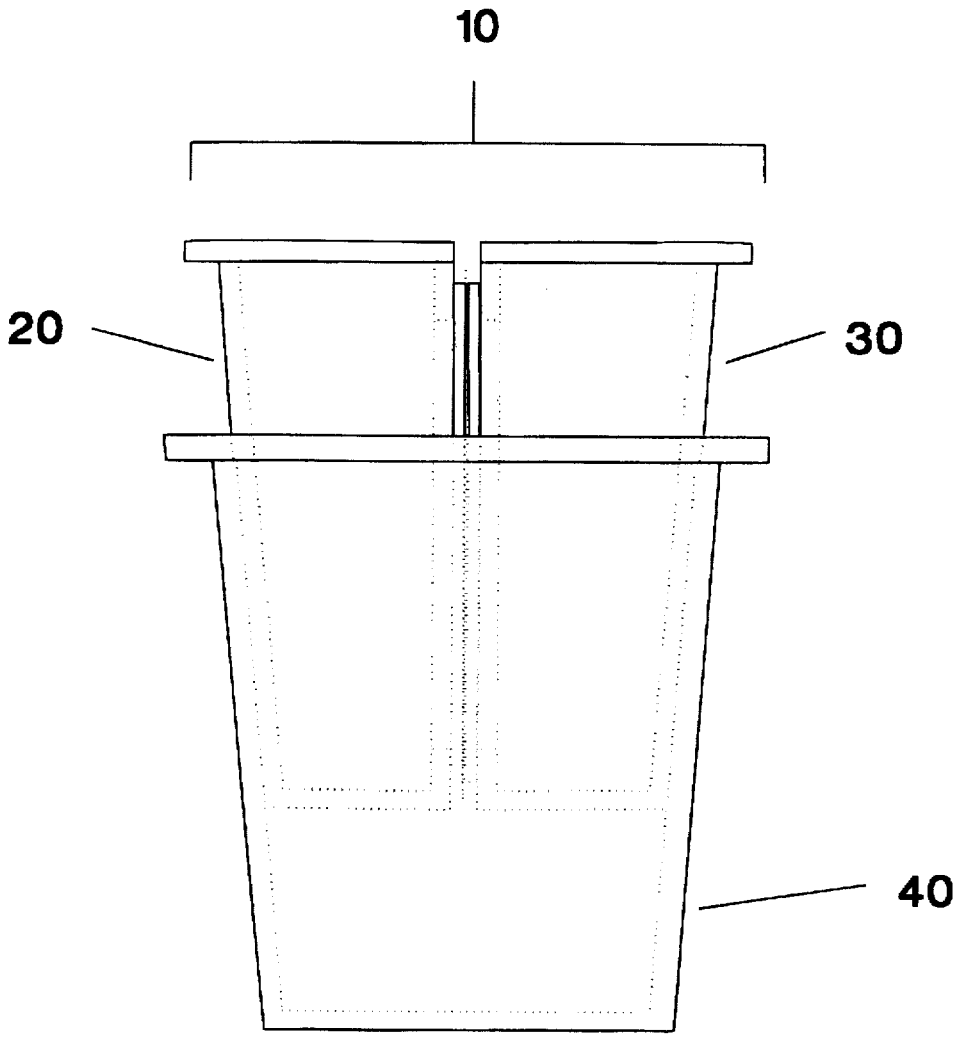
FIG. 1D is the same side view of the electrolytic cell and cell compression sleeve as illustrated in FIG. 1C; however the figure shows the position of the electrolytic cell within the cell compression sleeve.

FIGS. 1C and 1D best illustrate the dimensional features of cell 10 and cell compression sleeve 40. As shown in FIG. 1C, cell 10 is to have an inverted pyramidal, inverted conical, or wedge shape having a tapered dimension 11 that is uniform along the sides or surfaces opposite of the junction between anode compartment 20 and cathode compartment 30. In this particular example, cell 10 has an inverted pyramidal shape having dimensions of approximately 25 centimeters by 38 centimeters (10 inches by 15 inches) at the bottom and 30 centimeters by 45 centimeters (12 inches by 18 inches) at the top and having a depth of approximately 50 centimeters (20 inches). The interior of cell compress ion sleeve 40 is to have the same shape as cell 110, having the same tapered dimension I1 where the exterior surface of cell 10 meets the interior surface of cell compression sleeve 40 as illustrated in FIG. 1D. In the assembled form, cell 10 extends approximately 13 to 15 centimeters (5 to 6 inches) above the top of cell compression sleeve 40. This space is used for pipe fitting connections to other processes or systems of the chlor-alkali process.

FIG. 1B shows an isometric illustration of the invention in the disassembled form. As shown by FIG. 1B, anode compartment 20 is in open communication with cathode compartment 30 through an anode opening 22 encompassed by an anode flange 21 and a cathode opening 32 encompassed by a cathode flange 31. In this particular example, the size of anode opening 22 and cathode opening 32 is approximately 18 centimeters (7 inches) along the bottom horizontal dimension and 20 centimeters (8 inches) along the top horizontal dimension by a length of approximately 40 centimeters (16 inches) between the top and bottom dimensions, each. The dimensions of the open communication between anode compartment 20 and cathode compartment 30 are in symmetrical alignment when cell 10 is positioned within cell compression sleeve 40. Anode compartment 20 is hydraulically isolated from cathode compartment 30 by a membrane 50 at the junction of anode compartment 20 and cathode compartment 30. Membrane 50 is a cation selective permionic or other type of membrane used in the chlor-alkali process. More specifically, membrane 50 may be fabricated of a fluorocarbon resin containing active acid groups such as carboxylic acid groups, sulfonic acid groups, derivatives of these groups, or mixture of two or more of those groups. Membrane 50 may include a PTFE reinforcement mesh to add structural rigidity. Thus, membrane 50 provides electrically conductive communication between anode compartment 20 and cathode compartment 30. The dimension of membrane 50 encompasses the outside edge circumference of anode flange 21 and cathode flange 31. In this particular example, membrane 50 has an area of approximately 30 centimeters by 50 centimeters (12 inches by 20 inches).

Anode compartment 20 and cathode compartment 30 are hydraulically isolated from the outside environment by an anode seal 60 and a cathode seal 61. Anode seal 60 and cathode seal 61 are made of a flexible synthetic material of variable thickness and shape having elastic properties including butyl rubber; ethylene polypropylene rubber such as BPDM, EPT, EPR; chloroprene rubber such as Neoprene ®; or fluorine rubber such as Viton ®. More specifically, the material for anode seal 60 should be chemically resistant to the anolyte contained in anode compartment 20, and the material for cathode seal 61 should be chemically resistant to the catholyte contained in cathode compartment 30. Anode seal 60 and cathode seal 61 further having a hardness of less than 90 durometer, preferably less than 70 durometer. In this particular example, cathode seal 61 consists of a 3 millimeter (⅛ inch) thick flat EPDM rubber sheet having the same dimensions of cathode flange 31. Anode seal 60 consists of a 6.35 millimeter (¼ inch) diameter EPDM rubber o-ring material fitted within a groove or depression encompassing the surface of anode flange 21.

Cell compression sleeve 40 uniformly compresses anode compartment 20, cathode compartment 30, and membrane 50 at anode seal 60 on anode flange 21 and cathode seal 61 on cathode flange 31. The surface features of cell compression sleeve 40 and cell 10 have frictional properties capable of maintaining compression of anode compartment 20, cathode compartment 30, and membrane 50 at anode seal 60 on anode flange 21 and cathode seal 61 on cathode flange 31. Tapered dimension 11 of approximately 1/20 the height of cell 10 has demonstrated excellent frictional properties between cell 10 and cell compression sleeve 40, both constructed of a fiberglass material. Such frictional properties have maintained compression forces between anode compartment 20 and cathode compartment 30 that provide an environmentally sealed system under a vacuum exceeding 25 centimeters (10 inches) of mercury and a pressure up to 20 $kN/m^2$ (3 pounds per square inch). Other shape and material configurations of cell 10 and cell compression sleeve 40 with a different seal hardness of anode seal 60 and cathode seal 61 demonstrate higher vacuum and pressure ratings.

FIG. 1B further illustrates an anode 70 positioned within anode compartment 20 through an anode compartment opening 23 closed by an anode lid 24. Anode 70 is made of an electrically conductive material that is chemically resistant to the chlorine gas and anolyte in anode compartment 20. Such material includes graphite carbon, or titanium, zirconium, niobium, tungsten or tantalum having a coating of an electrically conductive electrocatalytically material of platinum rhodium, iridium, ruthenium, osmium or palladium, and/or oxide of one or more of these metals. One common example is a platinum coated titanium anode with a solid or mesh form. The width of anode 70 is slightly larger than the bottom horizontal dimension of anode opening 22. In this particular example, anode 70 is approximately 20 centimeters (8 inches) in horizontal dimension by 40 centimeters (16 inches) in vertical dimension. Anode 70 further having an anode stem 71 of same material that is rigidly attached, welded, or contiguous with anode 70 and extending vertically out of anode compartment 20 through an anode stem opening 26 on anode lid 24. In this particular example, anode stem 71 consists of two rigid angle extensions welded to anode 70 with a 12.7 millimeter (½ inch) diameter threaded stud welded at the top face of each angle extension.

Anode compartment opening 23 is environmentally sealed by compression of an anode lid seal 62 between anode lid 24 and an anode compartment flange 25 surrounding anode compartment opening 23, and compression of an anode stem seal 63 between anode stem 71 and anode lid 24. An anode stem compression system 72 compresses anode stem seal 63 between anode stem 71 and anode lid 24 at anode stem opening 26. Anode stem compression system 72 may be a threaded nut and washer in connective communication with a similarly threaded anode stem 71. The materials of anode stem compression system 72 should be of the same material as anode stem 71, or compatible material to avoid undesirable galvanic coupling caused by dissimilar metals. Anode stem compression system 72 may also provide compression of anode lid seal 62 provided that anode 70 is firmly attached to anode compartment 20. Otherwise anode lid seal 62 may be compressed by the weight of anode lid 24 if constructed of a heavy material such as concrete, or by application of a series of fiberglass or plastic threaded connectors between anode lid 24 and anode compartment flange 25, or by a latch system similar to the latch associated with the lid of a typical 19 liter (5 gallon) polyethylene plastic bucket, or by a latch similar to a typical cabinet or suitcase latch, between anode lid 24 and anode compartment flange 25.

Anode lid seal 62 and anode stem seal 63 are made of flexible synthetic material of variable thickness and shape having elastic properties including butyl rubber; ethylene polypropylene rubber such as EPDM, EPT, EPR; chloroprene rubber such as Neoprene ® or fluorine rubber such as Viton ®. More specifically, the material for anode lid seal 62 and anode stem seal 63 should be chemically resistant to the chlorine gas and anolyte contained in anode compartment 20, and having a hardness of less than 90 durometer, preferably less than 70 durometer. In this particular example, anode lid seal 62 consists of a 6.35 millimeter (¼ inch) diameter EPDM rubber o-ring material fitted within a groove or depression encompassing the surface of anode compartment flange 25. Anode stem seal 63 is a 3 millimeter (⅛ inch) thick flat EPDM rubber sheet having an interior cutout dimension equal to the cross-sectional dimension of anode stem 71 and the exterior dimension exceeding the crossectional dimension of anode stem compression system 72.

FIG. 1B further illustrates a cathode 80 positioned within cathode compartment 30 through a cathode compartment opening 33 closed by a cathode lid 34. Cathode 80 is made of an electrically conductive material of similar dimensions of anode 70 that is chemically resistant to the hydrogen gas and catholyte in cathode compartment 30. Such material includes iron or steel, or of other suitable metal such as nickel. Cathode 80 further having a cathode stem 81 of same material that is rigidly attached, welded, or contiguous with cathode 80 and extending vertically out of cathode compartment 30 through a cathode stem opening 36 on cathode lid 34. In this particular example, cathode stem 81 consists of two rigid angle extensions contiguous with cathode 80 with a 12.7 millimeter (½ inch) diameter threaded stud welded at the top face of each angle extension.

Cathode compartment opening 33 is environmentally sealed by compression of a cathode lid seal 64 between cathode lid 34 and a cathode compartment flange 35 surrounding cathode compartment opening 33, and compression of a cathode stem seal 65 between cathode stem 81 and cathode lid 34. A cathode stem compression system 82 compresses cathode stem seal 65 between cathode stem 81 and cathode lid 34 at cathode stem opening 36. Cathode stem compression system 82 may be a threaded nut and washer in connective communication with a similarly threaded cathode stem 81. The materials of cathode stem compression system 82 should be of the same material as cathode stem 81, or compatible material to avoid undesirable galvanic coupling caused by dissimilar metals. Cathode stem compression system 82 may also provide compression of cathode lid seal 64 provided that cathode 80 is firmly attached to cathode compartment 30. Otherwise cathode lid seal 64 may be compressed by the weight of cathode lid 34 if constructed of a heavy material such as concrete, or by application of a series of fiberglass or plastic threaded connectors between cathode lid 34 and cathode compartment flange 35, or by a latch system similar to the latch associated with the lid of a typical 19 liter (5 gallon) polyethylene plastic bucket, or by a latch similar to a typical cabinet or suitcase latch, between cathode lid 34 and cathode compartment flange 35.

Cathode lid seal 64 and cathode stem seal 65 are made of flexible synthetic material of variable thickness and shape having elastic properties including butyl rubber; ethylene polypropylene rubber such as EPDM, EPT, EPR; or chloroprene rubber such as Neoprene ®. More specifically, the material for cathode lid seal 64 and cathode stem seal 65 should be chemically resistant to the hydrogen gas and catholyte contained in cathode compartment 30, and having a hardness less than 90 durometer, preferably less than 70 durometer. In this particular example, cathode lid seal 64 consists of a 6.35 millimeter (¼ inch) diameter EPDM rubber o-ring material fitted within a groove or depression encompassing the surface of cathode compartment flange 35. Cathode stem seal 65 is a 3 millimeter (⅛ inch) thick flat EPDM rubber sheet having an interior cutout dimension equal to the cross-sectional dimension of cathode stem 81 and the exterior dimension exceeding the crossectional dimension of cathode stem compression system 82.

Anode stem 71 and cathode stem 81 are independently connected by an electrical conduit 90 to the output of a power source 91. Electrical conduit 90 is a copper wire or cable of sufficient size to transmit the direct current amperage loading from power source 91 to cell 10. In this particular example, electrical conduit 90 consists of two # 1/0 AWG size copper stranded cables, each sufficient to transmit 150–200 direct current amperes from power source 91 to cell 10.

The invention can partake a different configuration as illustrated by the isometric representation shown in FIG. 2A. This invention would be used in small chlorine use applications where approximately 0.45–0.90 kilograms (1–2 pounds) of chlorine gas per day per cell are required. As shown in FIG. 2A, the invention is comprised of a cell 10B divided into an anode compartment 20B and a cathode compartment 30B. Continuity or attachment of anode compartment 20B with cathode compartment 30B is provided by a cell compression sleeve 40B.

Cell 10B is made of a rigid, non-electrically conductive material such as fiberglass, polyvinyl chloride (PVC) plastic, chlorinated polyvinyl chloride (CPVC) plastic, polyvinylidene fluoride (PVDF) plastic, polytetrafluoroethylene (PTFE) plastic or other plastics that are chemically resistant to the solutions and gases contained within cell 10B. More specifically, the material of anode compartment 20B must be chemically resistant to chlorine gas and anolyte contained in anode compartment 20B. The material of cathode compartment 30B must be chemically resistant to hydrogen gas and a catholyte contained in cathode compartment 30B.

FIG. 2B best illustrates the dimensional features of cell 10B and cell compression sleeve 40B. As shown in FIG. 2B, cell 10B may have a cylindrical or tubular shape, but can also have a shape in the configuration of a multi-sided polygon. The inside dimensions of cell 10B must be slightly larger than the dimensions of an anode 70B positioned within anode compartment 20B and a cathode 80B positioned within cathode compartment 30B. An annular space of 1.5 to 6 millimeters (1/16 to 1/4 inches) between the inside wall of cell 10B and the outside edges of anode 70B and cathode 80B is desirable. The junction of anode compartment 20B and cathode compartment 30B of cell 10B includes an anode flange 21B and a cathode flange 31B. As shown by FIG. 2B, anode flange 21B and cathode flange 31B are circular in configuration and are larger in diameter than the outside dimensions of cell 10B. Size and shape of anode flange 21B and cathode flange 31B are primarily dependent on the dimensions of cell compressive sleeve 40B.

Anode compartment 20B is in open communication with cathode compartment 30B through an anode opening 22B encompassed by anode flange 21B and a cathode opening 32B encompassed by cathode flange 31B. Anode compartment 20B is hydraulically isolated from cathode compartment 30B by a membrane 50B. Membrane 50B is a cation selective permionic membrane typically fabricated of a fluorocarbon resin containing active acid groups such as carboxylic acid sulfonic acid groups, derivatives of these groups, or mixture of two or more of those groups. Membrane 50B may include a PTFE reinforcement mesh to add structural rigidity. Thus membrane 50B provides electrically conductive communication between anode compartment 20B and cathode compartment 30B. The dimensions of membrane 50B encompasses the outside edge circumference of anode flange 21B and cathode flange 31B. In this particular example, membrane 50B has an approximate diameter of 13 centimeters (5 inches).

Anode compartment 20B and cathode compartment 30B are hydraulically isolated from the outside environment by an anode seal 60B and a cathode seal 61B. Anode seal 60B and cathode seal 61B are made of flexible synthetic material of variable thickness and shape having elastic properties including butyl rubber; ethylene polypropylene rubber such as EPDM, EPT, EPR; chloroprene rubber such as Neoprene ®; or fluorine rubber such as Viton ®. The material for anode seal 60B should be chemically resistant to the anolyte contained in anode compartment 20B, and the material for cathode seal 61B should be chemically resistant to the catholyte in cathode compartment 30B. Anode seal 60B and cathode seal 61B further having a hardness less than 90 durometer, preferably less than 70 durometer. In this particular example, cathode seal 61B consists of a 3 millimeter (1/8 inch) thick flat EPDM rubber sheet having the same dimensions of cathode flange 31B. Anode seal 60B consists of a 6.35 millimeter (1/4 inch) diameter EPDM rubber o-ring material fitted within a groove or depression encompassing the surface of anode flange 21B.

Cell compression sleeve 40B uniformly compresses membrane 50B between anode seal 60B on anode flange 21B and cathode seal 61B on cathode flange 31B. Cell compression sleeve 40B is made of a rigid material such as fiberglass, polyvinyl chloride (PVC) plastic, chlorinated polyvinyl chloride (CPVC) plastic, polyvinylidene fluoride (PVDF) plastic, polytetrafluoroethylene (PTFE) plastic, high density polyethylene HDPE) plastic, or various types of metal including stainless steel, aluminum, and titanium. Cell compressive sleeve 40B totally encompasses anode flange 21B and cathode flange 31B. A wedge or threaded configuration on cell compressive sleeve 40B compresses membrane 50B between anode seal 60B and cathode seal 61B. FIG. 2B illustrates a 5, 7.6, or 10 centimeter (2, 3, or 4 inch) diameter union pipe fitting having an exterior compression wedge 41B or thread firmly attached or contiguous with the exterior circumference of cathode flange 31B, and an interior compression wedge 42B or thread firmly attached or contiguous with the interior of a compression collar 43B. A compression collar opening 44B, defined by the interior circumference of a compression collar flange 45B on compression collar 43B, must be larger in diameter than the exterior dimensions of cell 10B and smaller in diameter that the outside dimensions of anode flange 21B or cathode flange 31B. Compression collar 43B is rotative having interior compression wedge 42B in symmetrical connective communication with exterior compression wedge 41B. The interior surface of compression collar flange 45B is in symmetrical communication with the back exterior surface of anode flange 21B where the surface of compression collar flange 45B meets the surface of anode flange 21B when interior compression wedge 42B is engaged in exterior compression wedge 41B.

FIG. 2B further illustrates anode 70B positioned within anode compartment 20B through anode opening 22B defined by the interior dimension of anode flange 21B. Anode 70B is made of an electrically conductive material that is chemically resistant to the chlorine gas and anolyte in anode compartment 20B. Such material includes graphite carbon, or titanium, zirconium, niobium, tungsten or tantalum having a coating of an electrically conductive electrocatalytically material of platinum rhodium, iridium, ruthenium, osmium or palladium, and/or oxide of one or more of these metals. One common example is a platinum coated titanium anode with a solid or mesh form. The size of anode 70B must be slightly smaller that the dimensions of anode opening 22B. Cell compression sleeve 40B consisting of a 7.6 centimeter (3 inch) diameter CPVC union pipe fitting, anode compartment 20B consisting of a 7.6 centimeter (3 inch) diameter schedule 80 CPVC pipe, requires a 7 centimeter (2.75 inch) diameter anode 70B which produces from 0.45–0.90 kilogram (1–2 pounds) of chlorine gas per cell per day. Anode 70B further having an anode stem 71B of same material that is rigidly attached or welded to anode 70B and extending horizontally out of anode compartment 20B through an anode stem opening 26B at the end of anode compartment 20B opposite of anode opening 22B. Anode stem 71B may be a threaded stem 6.35 millimeter (1/4 inch) in diameter and 15–18 centimeters (6–7 inches) long, welded perpendicular at right angles to the center inside face of anode 70B.

Anode stem opening 26B is environmentally sealed by compression of an anode stem seal 63B between anode stem 71B and anode compartment 20B at anode stem opening 26B. An anode stem compression system 72B compresses anode stem seal 63B between anode stem 71B and anode compartment 20B at anode stem opening 26B. Anode stem compression system 72B may be a threaded nut and washer in connective communication with a similarly threaded anode stem 71B. The materials of anode stem compression system 72B should be of the same material as anode stem 71B, or compatible material to avoid undesirable galvanic coupling caused by dissimilar metals.

Anode stem seal 63B is made of flexible synthetic material of variable thickness and shape having elastic properties including butyl rubber; ethylene polypropylene rubber such as EPDM, EPT, EPR; chloroprene rubber such as Neoprene ®; or fluorine rubber such as Viton ®. More specifically, the material for anode stem seal 63B should be chemically resistant to the chlorine gas and anolyte contained in anode compartment 20B, and have a hardness less than 90 durometer, preferably less than 70 durometer. In this particular example, anode stem seal 63B is a 3 millimeter (⅛ inch) thick flat EPDM rubber sheet having an interior cutout dimension equal to the cross-sectional dimension of anode stem 71B and the exterior dimension exceeding the cross-sectional dimension of anode stem compression system 72B.

FIG. 2B further illustrates cathode 80B positioned within cathode compartment 30B through cathode opening 32B defined by the interior dimension of cathode flange 31B. Cathode 80B is made of an electrically conductive material that is chemically resistant to the hydrogen gas and catholyte in cathode compartment 30B. Such material includes iron or steel, or of other suitable metal such as nickel. The size of cathode 80B must be slightly smaller that the dimensions of cathode opening 32B, and preferably the same size of anode 70B. Cathode 80B further having a cathode stem 81B of same material that is rigidly attached or welded to cathode 80B and extending horizontally out of cathode compartment 30B through a cathode stem opening 36B at the end of cathode compartment 30B opposite of cathode opening 32B. Cathode stem 81B may be a threaded stem 6.35 millimeter (¼ inch) in diameter and 15–18 centimeters (6–7 inches) long, welded perpendicular at right angles to the center inside face of cathode 80B.

Cathode stem opening 36B is environmentally sealed by compression of a cathode stem seal 63B between cathode stem 81B and cathode compartment 30B at cathode stem opening 36B. A cathode stem compression system 82B compresses cathode stem seal 65B between cathode stem 81B and cathode compartment 30B at cathode stem opening 36B. Cathode stem compression system 82B may be threaded nut and washer in connective communication with a similarly threaded cathode stem 81B. The materials of cathode stem compression system 82B should be of the same material as cathode stem 81B, or compatible material to avoid undesirable galvanic coupling caused by dissimilar metals.

Cathode stem seal 65B is made of flexible synthetic material of variable thickness and shape having elastic properties including butyl rubber; ethylene polypropylene rubber such as EPDM, EPT, EPR; or chloroprene rubber such as Neoprene ®. More specifically, the material for cathode stem seal 65B should be chemically resistant to the hydrogen gas and catholyte contained in cathode compartment 30B, and having a hardness of less than 90 durometer, preferably less than 70 durometer. In this particular example, cathode stem seal 65B is a 3 millimeter (⅛ inch) thick flat EPDM rubber sheet having an interior cutout dimension equal to the cross-sectional dimension of cathode stem 81B and the exterior dimension exceeding the crossectional dimension of cathode stem compression system 82B.

Anode stem 71B and cathode stem 81B are independently connected by an electrical conduit 90B to the output of a power source 91B. Electrical conduit 90B is a copper wire or cable of sufficient size to transmit the direct current amperage loading from power source 91B to cell 10B. In this particular example, electrical conduit 90B is a # 10 AWG size stranded copper wire capable of transmitting 15–30 direct current amperes from power source 91B to cell 10B.

OPERATION OF INVENTION

It should be understood that FIGS. 1B and 2B depict cell 10 (FIG. 1B) and cell 10B (FIG. 2B) in the pre-assembly mode. The illustration of the pre-assembly mode depicts the various elements of cell 10 and cell 10B prior to assembly of cell 10 and cell 10B. It should be further understood that FIGS. 1A and 2A depict cell 10 (FIG. 1A) and cell 10B (FIG. 2A) in the assembled mode. The illustration of the assembled mode depicts the configuration of cell 10 and cell 10B ready for operation.

To establish an operable cell 10 as shown in FIG. 1A, the components of cell 10 must be assembled as illustrated in FIGS. 1B and 1C. To assemble anode compartment 20, anode 70 is first placed within anode compartment 20 through anode compartment opening 23. Anode 70 is positioned directly behind anode opening 22 with anode stem 71 extending vertically upward from anode compartment opening 23. Anode lid 24 is positioned over anode compartment opening 23, having anode stem 71 extending through anode stem opening 26 on anode lid 24. Application of anode stem compression system 72 between anode stem 71 and anode lid 24 compresses anode stem seal 63. In this particular case, anode stem compression system 72 is a threaded nut and washer encompassing a similarly threaded anode stem 71 that is tightened with a force applied by an adequately sized wrench until anode stem seal 63 compresses and seals the annular space between the surface encompassing anode stem opening 26 and anode stem 71 from the outside environment. If anode 70 is rigidly attached to anode compartment 20, anode stem compression system 72 also compresses anode lid seal 62 between anode compartment flange 25 and anode lid 24, thus sealing anode compartment opening 23 from the outside environment. Otherwise compression of anode lid seal 62 must be accomplished by a number of latching methods including a molded latch encompassing the outside edge of anode lid 24 that connects beneath anode compartment flange 25 when a vertical force is applied to the top of anode lid 24 (similar to the placement of a plastic lid on a typically 19 liter (5 gallon) polyethylene plastic bucket), a typical cabinet or suitcase latch, or by several threaded connections between anode lid 24 and anode compartment flange 25.

The assembly of cathode compartment 30 follows the same procedures as described in the assembly of anode compartment 20. Nonetheless, cathode 80 is placed within cathode compartment 30 through cathode compartment opening 33. Cathode 80 is positioned directly behind cathode opening 32 with cathode stem 81 extending vertically upward from cathode compartment opening 33. Cathode lid 34 is positioned over cathode compartment opening 33, having cathode stem 81 extending through cathode stem opening 36 on cathode lid 34. Application of cathode stem compression system 82 between cathode stem 81 and cathode lid 34 compresses cathode stem seal 65. In this particular case, cathode stem compression system 82 is a threaded nut and washer encompassing a similarly threaded cathode stem 81 that is tightened with a force applied by an adequately sized wrench until cathode stem seal 65 compresses and seals the annular space between surface encompassing cathode stem opening 36 and cathode stem 81 from the outside environment. If cathode 80 is rigidly attached to cathode compartment 30, cathode stem compression system 82 also compresses cathode lid seal 64 between cathode compartment flange 35 and cathode lid 34, thus sealing cathode compartment opening 33 from the outside environment. Otherwise compression of cathode lid seal 64 must be accomplished by a number of latching methods including a molded latch encompassing the outside edge of cathode lid 34 that connects beneath cathode compartment flange 35 when a vertical force is applied to the top of cathode lid 34 (similar to the placement of a plastic lid on a typically 19 liter (5 gallon) polyethylene plastic bucket), a typical cabinet or suitcase latch, or by several threaded connections between cathode lid 34 and cathode compartment flange 35.

FIG. 1C illustrates the assembly of anode compartment 20 and cathode compartment 30 within cell compression sleeve 40. As shown in FIG. 1C, membrane 50 is positioned between anode seal 60 on anode flange 21 and cathode seal 61 on cathode flange 31, providing electrically conductive communication between anode opening 22 and cathode opening 32. Tape may be applied between anode compartment 20 and cathode compartment 30 to temporarily retain the placement of membrane 50 between anode seal 60 and cathode seal 61. Anode compartment 20 and cathode compartment 30 having membrane 50 positioned between anode seal 60 and cathode seal 61 is placed within cell compression sleeve 40. A vertical compressive force applied downward along the top of anode compartment 20 and cathode compartment 30 further positions cell 10 within cell compression sleeve 40. As cell 10 is positioned further within cell compression sleeve 40, the wedging or squeezing developed by tapered dimension 11 between cell 10 and cell compression sleeve 40 redistributes the vertical compressive force to a horizontal compressive force between anode compartment 20 and cathode compartment 30. The compressive force is applied symmetrically along anode seal 60 and cathode seal 61, thus sealing the interior of cell 10 from the outside environment. Frictional properties between the exterior surface of cell 10 and the interior surface of cell compression sleeve 40 maintain symmetrical compression of anode seal 60 on anode flange 21 and cathode seal 61 on cathode flange 31 when the vertical downward compressive force is removed.

Electrical conduit 90 is then connected to the environmentally exposed portion of anode stem 71 and cathode stem 81. Cell 10 is further connected to any other necessary appurtenances to allow proper operation of the chlor-alkali process.

Routine maintenance of cell 10 requires the removal of membrane 50 for cleaning, treatment, or replacement. Removal of membrane 50 is accomplished in the reverse manner described in the positioning of anode compartment 20 and cathode compartment 30 within compressive sleeve 40. An upward vertical tensile force applied between cell 10 and cell compression sleeve 40 releases cell 10 from cell compression sleeve 40. The amount of tensile force required to release cell 10 from compression sleeve 40 must exceed the static frictional force existing between the exterior surface of cell 10 and the interior surface of cell compression sleeve 40. It should be noted that disassembly of anode compartment 20 and cathode compartment 30 can be accomplished when cell 10 remains in position within cell compression sleeve 40.

To establish an operable cell 10B as shown in FIG. 2A, the components of cell 10B must be assembled as illustrated in FIG. 2B. To assemble anode compartment 20B, anode 70B is first placed within anode compartment 20B through anode opening 22B. Anode 70B is positioned directly behind anode opening 22B with anode stem 71B extending horizontally outward through anode stem opening 26B. Application of anode stem compression system 72B between anode stem 71B and anode compartment 20B compresses anode stem seal 63B. In this particular case, anode stem compression system 72B is a threaded nut and washer encompassing a similarly threaded anode stem 71B that is tightened with a force applied by an adequately sized wrench until anode stem seal 63B compresses and seals the annular space between the surface encompassing anode stem opening 26B and anode stem 71B from the outside environment.

The assembly of cathode compartment 30B follows the same procedures as described in the assembly of anode compartment 20B. Nonetheless, cathode 80B is placed within cathode compartment 30B through cathode opening 32B. Cathode 80B is positioned directly behind cathode opening 32B with cathode stem 81B extending horizontally outward through cathode stem opening 36B. Application of cathode stem compression system 82B between cathode stem 81B and cathode compartment 30B compresses cathode stem seal 65B. In this particular case, cathode stem compression system 82B is a threaded nut and washer encompassing a similarly threaded cathode stem 81B that is tightened with a force applied by an adequately sized wrench until cathode stem seal 65B compresses and seals the annular space between the surface encompassing cathode stem opening 36B and cathode stem 81B from the outside environment.

Following installation of anode 70B in anode compartment 20B and cathode 80B in cathode compartment 30B, membrane 50B is positioned between anode seal 60B on anode flange 21B and cathode seal 61B on cathode flange 31B, providing electrically conductive communication between anode opening 22B and cathode opening 32B. With cell 10B remaining fixed in position, compression collar 43B having interior compression wedge 42B is rotated onto exterior compression wedge 41B which is rigidly attached or contiguous with the exterior circumference of cathode flange 31B. Interior compression wedge 42B being in connective communication with exterior compression wedge 41B allows compression collar flange 45B to uniformly seat or meet with the exterior back surface of anode flange 21B. When the interior surface of compression collar 45B meets the exterior back surface of anode flange 21B, the wedging or squeezing developed by the added torque or rotational force applied to compression collar 43B between interior compressive wedge 42B and exterior compressive wedge 41B redistributes the torque or rotational force to a compression force between anode flange 21B and cathode flange 31B. The compressive force is applied symmetrically along anode seal 60B and cathode seal 61B, thus sealing the interior of cell 10B from the outside environment. Frictional properties between the surface of interior compressive wedge 42B and the surface of exterior compressive wedge 41B of cell compression sleeve 40B maintain symmetrical compression of anode seal 60B on anode flange 21B and cathode seal 61B on cathode flange 31B when the torque or rotational force is removed.

Electrical conduit 90B is then connected to the environmentally exposed portion of anode stem 71B and cathode stem 81B. Cell 10B is further connected to any other necessary appurtenances to allow proper operation of the chlor-alkali process.

Routine maintenance of cell 10B requires the removal of membrane 50B for cleaning, treatment, or replacement. Removal of membrane 50B is accomplished by applying a torque or rotational force to compression collar 43B in the opposite direction stipulated in the assembly mode. The amount of torque or rotational force required to release cell 10B from compression sleeve 40B must exceed the static frictional force existing between the surface of interior compressive wedge 42B and the surface of exterior compressive wedge 41B of cell compression sleeve 40B.

CONCLUSIONS, RAMIFICATIONS, AND SCOPE OF INVENTION

As with the prior art, the novel apparatus depicted above provides a much simpler means to install a membrane that hydraulically isolates the anode compartment from the cathode compartment of a typical chlor-alkali cell. In addition, this invention eliminates all possibility of electrolyte leakage between the cell compartments resulting from migration or leakage of electrolyte around the membrane. The invention further provides a visible means to determine when the membrane seals need replacement following leakage of electrolytes from the seals between the membrane and cell compartments.

It will thus be seen that the objects set forth above, and those made apparent from the foregoing description, are efficiently attained and since certain changes may be made in the above construction without departure from the scope of the invention, it is intended that all matters contained in the foregoing description or shown in the accompanying shall be interpreted as illustrative and not in a limiting sense.

It is also to be understood that the following claims are intended to cover all of the generic and specific features of the invention herein described, and all statements of the scope of the invention which, as a matter of language, might be said to fall there between.

Now that the invention has been described, what is claimed is:

1. An apparatus for containing components of an electrolysis cell having, an anode compartment, a cathode compartment, and a membrane positioned between said anode compartment and said cathode compartment, said apparatus comprising:

said membrane positioned between said cathode compartment and said anode compartment providing hydraulic isolation between said cathode compartment and said anode compartment;

said membrane providing electrically conductive communication between said anode compartment and said cathode compartment;

said membrane extending to the exterior surfaces of said cathode compartment and said anode compartment;

a cell compression means able to transfer a single exterior force into a uniform horizontal compressive force between said anode compartment and said cathode compartment at said membrane; and said anode compartment in communication with said cathode compartment having a vertically symmetrical shape in a linear tapered form with a top horizontal crossectional area of said anode compartment in communication with said cathode compartment being larger than the bottom horizontal crossectional area of said anode compartment in communication with said cathode compartment.

2. The apparatus as defined in claim 1, wherein said cell compression means having the same said vertically symmetrical shape of sufficient size providing a uniform containment of said anode compartment in communication with said cathode compartment thus transferring said single exterior force applied downward at top of said anode compartment and said cathode compartment to said uniform horizontal compressive force on said membrane positioned between said cathode compartment and said anode compartment.

3. The apparatus as defined in claim 2, wherein said cell compression means having a surface with sufficient frictional properties able to retain said uniform horizontal compressive force when said single exterior force is removed.

4. The apparatus as defined in claim 1, wherein said cell compression means having a seal capable of absorbing said uniform horizontal compressive force and thereby providing hydraulic isolation along the junction of said anode compartment and said cathode compartment at said membrane.

5. An apparatus for containing components of an electrolysis cell having, an anode compartment, a cathode compartment, and a membrane positioned between said anode compartment and said cathode compartment, said apparatus comprising:

said membrane positioned between said cathode compartment and said anode compartment providing hydraulic isolation between said cathode compartment and said anode compartment;

said membrane providing electrically conductive communication between said anode compartment and said cathode compartment;

said membrane extending to the exterior surfaces of said cathode compartment and said anode compartment;

a cell compression means able to transfer a single exterior force into a uniform horizontal compressive force between said anode compartment and said cathode compartment at said membrane;

said cell compression means encompasses an anode flange connected to said anode compartment and a cathode flange connected to said cathode compartment at said membrane positioned between said anode compartment and said cathode compartment;

said cell compression means having a connective means that transfers said single exterior force applied rotationally along said connective means to said uniform horizontal compressive force on said membrane positioned between said cathode compartment and said anode compartment; and said connective means having a surface with sufficient frictional properties able to retain said uniform horizontal compressive force when said single exterior force is removed.

6. The apparatus as defined in claim 5, wherein said cell compression means having a seal capable of absorbing said uniform horizontal compressive force and thereby providing hydraulic isolation along the junction of said anode compartment and said cathode compartment at said membrane.

7. The apparatus as defined in claim 5, wherein said cell compression means is a union pipe fitting.

8. A method of containing components of an electrolysis cell containing, an anode compartment, a cathode compartment, and a membrane positioned between said anode compartment and said cathode compartment, said method comprising the steps of:

positioning said anode compartment and said cathode compartment in connective communication with a union pipe fitting;

applying a rotational exterior force to said union pipe fitting which results in a uniform compressive force at the junction of said anode compartment and said cathode compartment at said membrane where said uniform compressive force acting on a seal at the junction of said anode compartment and said cathode compartment at said membrane hydraulically isolates said electrolysis cell from the exterior environment; and maintaining said uniform compressive force at the junction of said anode compartment and said cathode compartment at said membrane when said rotational exterior force is removed.

* * * * *